United States Patent [19]

Overlack

[11] 4,366,020

[45] Dec. 28, 1982

[54] APPARATUS FOR BONDING WOOD GIRDERS

[75] Inventor: Claus Overlack, Gernsbach, Fed. Rep. of Germany

[73] Assignee: Casimir Kast GmbH & Co. KG, Gernsbach, Fed. Rep. of Germany

[21] Appl. No.: 300,222

[22] Filed: Sep. 8, 1981

[30] Foreign Application Priority Data

Sep. 30, 1980 [DE] Fed. Rep. of Germany ..... 3036793

[51] Int. Cl.[3] ..... B30B 15/30; B30B 15/34

[52] U.S. Cl. ..... 156/380.2; 100/93 P; 100/224; 144/242 E; 144/348; 156/274.6; 156/379.8; 156/581; 156/583.1; 219/10.81

[58] Field of Search ..... 156/273.7, 274.6, 379.8, 156/380.2, 380.3, 581, 583.1, 583.91; 219/10.81; 100/913, 93 P, 223, 224; 144/317, 242 E

[56] References Cited

U.S. PATENT DOCUMENTS 2,571,604 10/1951 Payzant ..... 156/273.7
2,783,349 2/1957 Warren ..... 219/10.81
3,191,522 6/1965 Drake et al. ..... 100/93 P
3,255,943 6/1966 Sanford ..... 100/913
3,752,060 8/1973 Hubert et al. ..... 100/224

FOREIGN PATENT DOCUMENTS 54-14622 6/1979 Japan ..... 156/583.1

*Primary Examiner*—Michael G. Wityshyn
*Attorney, Agent, or Firm*—Sandler & Greenblum

[57] ABSTRACT

An apparatus for producing girders, as for example I girders, from lengths of wood forming the flanges and the web of the girder has a carriage running on rails through a first station in which lengths of wood are placed thereon for forming the girder, a pressing station in which the so put-together girder is first acted upon by an upright force normal to its web and parallel to its flanges, and then by a greater force acting horizontally on the girder so that the parts of the girder are kept lined up and in righted, straight condition, and through a HF station in which the girder is moved past HF electrodes for acting on the glue in the joins of the girder.

14 Claims, 4 Drawing Figures

APPARATUS FOR BONDING WOOD GIRDERS

GENERAL BACKGROUND OF THE INVENTION

The present invention is with respect to an apparatus for bonding or gluing running lengths of wood rod or section for making wood girders, as for example T and I girders, using high frequency heating, and made up of a support on which the lengths of wood may be rested in lined-up condition, a pressing system for pressing the said lengths from the side with a force acting towards at least one bond between the said lengths, and a transporter for moving the pressed-together girder, made up of the said lengths, between and past fixed electrodes of a HF heating system.

HF gluing or bonding for structures made of wood has, it is true, been used for a number of decades, but however in the trade it is limited to a small number of purposes, because the forms of the bonded join generally do not keep to the right conditions for such HF bonding or because it is not possible to keep to the tight size limits on producing the separate parts of the wood structure and piecing them together. For this reason wood girders for trusses, ties, supports etc. are so far produced using normal ways of bonding. In the case of T and I girders for this reason the flanges are grooved to take up the edges of the web and then, after coating with glue are placed on the web. For making such girders or sections one process using HF bonding has been put forward in the case of which the girder is placed flat on a support, that is to say with the web parallel to the support and endless pressing belts are used for taking up the girder and acting on the sides thereof. These pressing belts, having at the same time a transport function as well as a pressing function, are responsible for moving the girder past the fixed-position electrodes of the HF unit so that the glue or other bonding material goes into a solid condition, the completed girder then being freed after coming from the HF unit.

It will be seen that this process is in a certain sense continuous, this lowering the price of making the girder, but however so far the desired quality has not been produced, inasmuch as the girders coming off the plant are not truly straight with respect to the flanges or the web along the length of the girder; and furthermore the bonded join is of low quality because it would seem that the pressing belts are not able to keep the join with the adhesive in it fully pressed together.

OUTLINE OF THE INVENTION

One purpose of the present invention is that of designing an apparatus of the sort noted which is in the position of producing girders which in every respect are of high quality.

For effecting this purpose, and still further purposes, the transporter is a carriage having a floor and side walls designed to take up the girder between the side walls, the carriage being designed with a length equal to the length of the longest girder to be bonded, and having the pressing system on at least one of the side walls, the apparatus further having a fixed-position pressing unit for pressing the lengths against the floor, while at the same time lining up the lengths in relation to each other, and a system for firstly working the pressing unit and then the pressing system, the last-named keeping the lengths of wood in the girder in relation to each other after being freed or let go of by the pressing unit.

A short, general account will now to given of the workings of the apparatus of the invention: The rods put together for forming the girder are placed in the carriage on the support, this may be undertaken right in front of or within the pressing unit. Nextly the pressing unit is put into operation for pushing all parts of the girder, that is to say in the case of an I girder, the two flanges and the web, against the support. When this working step takes place, the web and furthermore the flanges are bent straight so as to put an end to any effects of warping and twisting (no rods of the length used for making girders are free of such twisting), that is to say, the rods on the one hand are righted and trued up and furthermore put in the desired position in relation to each other. In this position however the flanges may still be bent or curved in the plane of the web and warped. After this working step the pressing system is put into operation so that the two flanges are pushed against the web for putting an end to any warping and curving of the flanges in the plane of the web. At the same time the pressing system makes certain of regular, even glued join along the full length of the girder. The girder is then freed by the pressing unit so that the girder is in fact only gripped by the pressing system on the side walls of the carriage. The carriage may then be moved to the high frequency unit where it is moved between a hot electrode and a cold electrode which are placed in the one case over and in the other case under the glued join. The girder coming from the HF unit is completely straight and has a high-quality bond meeting all needs.

As part of one working example of the invention the pressing unit is made up of a number of fluid pressure cylinders spaced along the length of the girder for acting on the lengths of wood thereof. Each such fluid pressure cylinder may be designed for acting on a pressing shoe whose form is in line with the top side of the lengths within the girder in their position in relation to each other so that the least possible number of fluid power cylinders is needed.

As part of a further working example of the invention the carriage is designed running on rails stretching through a first station in which the girder is put together on the carriage, the pressing unit, the HF unit and a station in which the bonded, completed girder is taken from the carriage. The carriage may be designed to be moved backwards and forwards between these stations and units or it may be designed for running on an endless path from the first station to the station in which it is taken therefrom and then it goes back to the first station. Such an endless path or track may be in a round form in a horizontal plane or may be made up of straight parts with moving stages. Furthermore however it may have a return path, placed under or over the floor of the works, with lifting systems at the head ends.

A preferred working example of the invention is characterized in that the pressing system is made up of one or more air power actuators each having an air pressure space within it and for example along one side wall of the carriage. It is possible to have inflatable pipes walled off into one or more spaces into which compressed air is let for pressing on the girder. This form of the invention makes certain of an even pressing effect along the full length of the girder and furthermore trouble conditions therewith are unlikely. Furthermore, from the point of view of plant engineering, there is a useful effect with such a design inasfar as nearly every wood processing plant has an air compressor.

A further useful effect is produced if the force produced by the pressing system acting on the side of the girder is at least twice as great as the force acting in an upright direction and produced by the pressing unit, this making certain that after the pressing unit has been turned off, the lengths of material in the girder are not able to go back into their bent form or get into position in which they are no longer lined up in relation to each other.

Furthermore a useful effect is produced if the support in the carriage and/or the pressure shoes of the pressing unit take the form of templates, having the same form as the outline of the girder, it being possible for such templates to be exchanged for different sorts of templates for different forms of girder. With such a system the time needed for retooling the apparatus for producing a different form of girder is made as short as possible.

A further useful effect is produced if the electrodes of the HF unit are placed on supports and are such that adjustment to different girder outlines is possible so that, when the design of girder to be produced is changed, the retooling times are as short as possible with respect to the HF unit as well.

Lastly, as part of a further development of the invention, the electrodes of the HF unit may have sliding shoes acting as spacers for resting against the length of wood of the girder near the join or joints and in this respect a useful effect is produced if the electrodes are acted upon by a spring force pushing them up against the glue joints. In this respect it is possible to make certain that on the one hand the electrodes are placed in all cases as near as possible to the glue joins and on the other hand are equally spaced therefrom. This is very important for the quality of the bonds produced.

LIST OF FIGURES

An account will now be given of one working example of the invention to be seen diagrammatically in the figures.

DETAILED ACCOUNT OF WORKING EXAMPLE OF THE INVENTION

Figure 1:
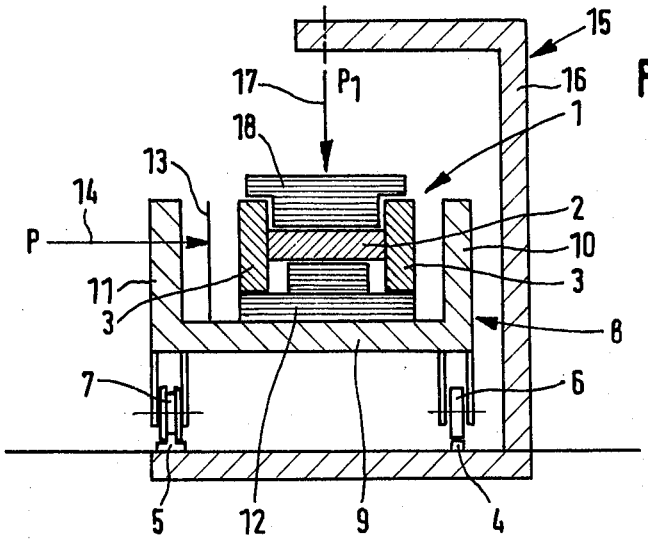
FIG. 1 is a cross-section through the apparatus at the pressing system.

The working example to be seen in the figures is in the condition used for bonding an I girder 1 made up of lengths of wood, that is to say a web 2 and flanges 3 placed at its edges.

The apparatus firstly has a transporter in the form of a carriage 8 supported by wheels 6 and 7 running on rails 4 and 5. At least one wheel 7 is designed as a guide wheel, for example with two flanges, so that the carriage 8 is guided with the least possible amount of play. In place of flanges it would naturally be possible to have further wheels resting against the sides of the rail or rails. The carriage 8 has a floor 9 and opposite side walls 10 and 11, between which the lengths of wood of the girder 1 are placed. On the floor 9 of the carriage 8 there is a support in the form of a template with a form the same as the lower outline of the girder. One of the side walls—in the present working example, the side wall 11—has a pressing system which is marked diagrammatically in the figure as a pressing plate 13 with a direction P (arrow 14). This pressing system takes effect from the side on the left hand flange 3 of girder 1 while the other side wall has the function of supporting the opposite flange 3. It is possible for a wood board or the like to be placed between the right hand side wall and the girder.

Figure 3:
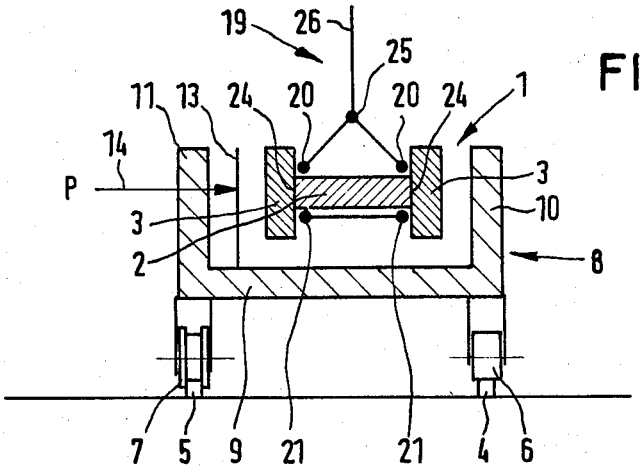
FIG. 3 is a cross-section at the HF heating unit.
Figure 2:
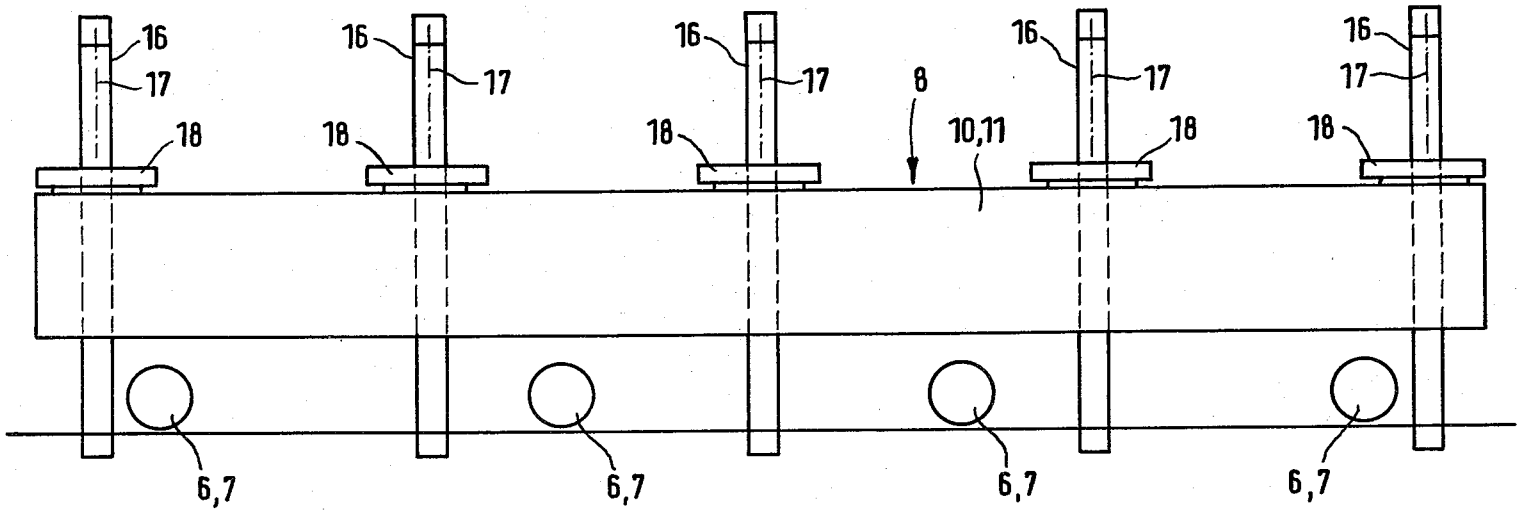
FIG. 2 is a side view thereof.

The apparatus furthermore has a fixed-position pressing unit 15 which in the present working example is made up of a number of spaced L-like frames 16 (see FIGS. 1 and 2) whose horizontal top beams are joined up with upright fluid power cylinders marked diagrammatically by direction arrow 17. The fluid power cylinders take effect on the top part of web 2 and on flanges 3 by way of one or more pressing pieces 18 (direction P1) so that flanges 3 are acted upon by the same force. Pressing piece or shoe such as 18 may as well be designed as a template in line with the outline of the girder. Under the pressing unit 15 the web 2 and the flanges 3 are pushed downwards by way of fluid power cylinders 17 against the support 12 so that they are not only righted or made straight, but furthermore lined up with each other. After this the pressing system 13, 14 is put into operation so that the girder 1 is acted upon by horizontal forces pushing it together, the level of such forces being about three times that of the pressing force produced by cylinders 17. Then pressing cylinders 17 are moved back into their starting position, so that the carriage is freed by the pressing unit 16 and so that it may be moved to the HF heating unit to be seen in FIG. 3.

Figure 4:
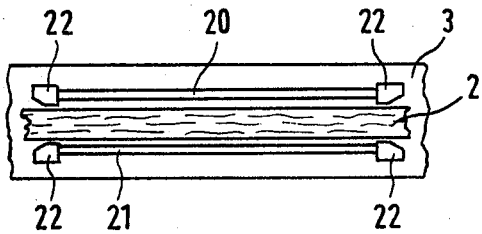
FIG. 4 is a part side view at the HF heating unit.

The HF unit 19 has two top electrodes 20 as hot electrodes and two lower electrodes 21 as cold electrodes, between which the girder 1 with its web 2 is moved using carriage 8. As will be seen from FIG. 4, electrodes 20, 21 have, at least at their ends, sliding shoes 22 whose end edges are cut back at an angle, such shoes 22 being used as spacers for keeping the desired distance from the web 2 and the flanges 3. It is best if the electrodes are acted upon by spring forces in an upright and horizontal direction so that by way of the sliding shoes 22 acting as spacers an even distance from the glued join 24 (see FIG. 3) is kept to in all cases. The even pressing force may be produced in a simple way if the electrodes 20 are joined up by way of a link 25 with a support 26 which for its part is acted upon by an upright spring. With such a system the position of the electrodes 20, 21 may be changed to be in line with different girder forms.

The embodiments of the invention in which an exclusive property or privilege is claimed are:

1. In an apparatus for the HF bonding of lengths of wood together for forming a wood girder, made up of a support on which such lengths of wood may be rested in a lined-up condition, a pressing system for pressing the said lengths at a side thereof and acting towards at least one bond therebetween, and a transporter for moving the pressed-together girder made up of the said lengths past HF electrodes, the invention residing in that said transporter is a carriage having a floor and side walls designed to take up the girder between the side walls, the carriage being designed with a length equal to that of the longest girder to be bonded and having said pressing system on at least one of said side walls, said apparatus further having a fixed-position pressing unit for pressing the said lengths against said floor while at the same time lining up the same in relation to each other, and a system for firstly working the pressing unit and then the pressing system, the last-named keeping the said lengths in the girder in relation to each other after being freed by said pressing unit.

2. The apparatus as claimed in claim 1 wherein said pressing unit is made up of a number of pressing cylinders spaced along the length of the girder.

3. The apparatus as claimed in claim 2 having separate pressing shoes designed for use with each pressing cylinder and having a form such as to be in line with the top faces of the said lengths of the girder when lined up in the desired relation to each other.

4. The apparatus as claimed in claim 3 having a first station in which said lengths may be placed on said carriage, a pressing station placed between the HF unit and the first station, and a last station wherein the girder may be taken from the carriage, and having rails for supporting said carriage for motion from one station to an other.

5. The apparatus as claimed in claim 4 wherein said carriage may be moved along an endless path from the first station to the last station and then back to the first station.

6. The apparatus as claimed in claim 1 wherein said pressing system is made up of at least one air power actuator with an air pressure space within it.

7. The apparatus as claimed in claim 1 wherein said pressing system is designed for producing a pushing force at least two times greater than the pushing force produced by said pressing unit.

8. The apparatus as claimed in claim 7 wherein said pressing system is designed for producing a pushing force at least three times greater than the pushing force produced by said pressing unit.

9. The apparatus as claimed in claim 1 having between the pressing unit and said carriage floor at least one template designed to be forced against said girder in an upright direction, said template having a face in line with the form of the girder and being designed to be taken off the apparatus and having its place taken by another such template for a different form of girder.

10. The apparatus as claimed in claim 9 wherein said template takes the form of a separate shoe designed to be in line with the top faces of said lengths of the girder when lined up in the desired relation to each other.

11. The apparatus as claimed in claim 1 having electrode supports for the electrodes of the HF unit such that adjustment of the electrode positions may take place to be in line with different girder designs.

12. The apparatus as claimed in claim 1 wherein said HF electrodes have sliding shoes for acting as spacers and resting against the lengths of the girder at the joins.

13. The apparatus as claimed in claim 1 having a system for springingly forcing the electrodes towards the joins.

14. The apparatus as claimed in claim 1 wherein said pressing system is in the form of an inflatable pipe walled off into separate air spaces and positioned between the two said walls of said carriage.

* * * * *